US012583492B2

(12) United States Patent
Shimomura et al.

(10) Patent No.: US 12,583,492 B2
(45) Date of Patent: Mar. 24, 2026

(54) TRANSPORT CART SYSTEM

(71) Applicant: MURATA MACHINERY, LTD., Kyoto (JP)

(72) Inventors: Akito Shimomura, Ise (JP); Toru Hamaguchi, Ise (JP); Naoki Manabe, Ise (JP); Hiroaki Izumi, Ise (JP)

(73) Assignee: MURATA MACHINERY, LTD., Kyoto (JP)

( * ) Notice: Subject to any disclaimer, the term of this patent is extended or adjusted under 35 U.S.C. 154(b) by 82 days.

(21) Appl. No.: 18/036,964

(22) PCT Filed: Nov. 16, 2021

(86) PCT No.: PCT/JP2021/042111
§ 371 (c)(1),
(2) Date: May 15, 2023

(87) PCT Pub. No.: WO2022/158098
PCT Pub. Date: Jul. 28, 2022

(65) Prior Publication Data

US 2024/0017752 A1 Jan. 18, 2024

(30) Foreign Application Priority Data

Jan. 20, 2021 (JP) ..... 2021-006992

(51) Int. Cl.
*B61L 23/00* (2006.01)
*B61L 27/04* (2006.01)

(52) U.S. Cl.
CPC ..... *B61L 27/04* (2013.01); *B61L 23/00* (2013.01)

(58) Field of Classification Search
CPC ..... B61L 27/04; B61L 23/00; B61L 21/06; B61L 29/30; B61L 19/08; B61L 1/163;
(Continued)

(56) References Cited

U.S. PATENT DOCUMENTS 10,689,016 B2 6/2020 Woo et al.
2008/0121481 A1* 5/2008 Mitsuhashi ..... H02J 50/10 191/10

(Continued)

FOREIGN PATENT DOCUMENTS

CN 108237921 A 7/2018
CN 110726903 A 1/2020

(Continued)

OTHER PUBLICATIONS

Official Communication issued in corresponding European Patent Application No. 21921201.6, mailed on Oct. 10, 2024, 10 pages.

*Primary Examiner* — Kurt Philip Liethen
*Assistant Examiner* — Anthony Donald Taylor, Jr.
(74) *Attorney, Agent, or Firm* — Keating & Bennett, LLP

(57) ABSTRACT

A transport vehicle system includes a transport vehicle to travel along a track, a controller to control the transport vehicle, and a power supply provided at each of a plurality of sections of the track. Each of the power supplies includes a sensor to monitor a state of the power supply and a communicator to transmit the monitoring result by the monitor to the controller. The controller is configured or programmed to control the transport vehicle in accordance with the monitoring result.

7 Claims, 6 Drawing Sheets

(58) Field of Classification Search
CPC .... B61L 3/14; B61L 3/16; B61L 15/00; B61L 27/00; B61L 2027/204; B61L 27/70
USPC ..... 701/19
See application file for complete search history.

(56) References Cited

U.S. PATENT DOCUMENTS

| | | | | |
|---|---|---|---|---|
| 2012/0145500 | A1* | 6/2012 | Staunton | H02J 50/10 191/22 R |
| 2016/0046306 | A1* | 2/2016 | Miyajima | B61L 19/06 701/19 |
| 2018/0015937 | A1* | 1/2018 | Woo | B61L 27/20 |
| 2020/0288285 | A1* | 9/2020 | Hosobuchi | H04W 4/40 |

FOREIGN PATENT DOCUMENTS

| | | | | |
|---|---|---|---|---|
| EP | 3663160 | A1 | 6/2020 | |
| JP | 2006238591 | A | 9/2006 | |
| JP | 2008104245 | A | 5/2008 | |
| JP | 3663160 | A1 * | 6/2010 | B61L 27/53 |
| JP | 2012060771 | A * | 3/2012 | B60L 5/00 |
| JP | 2013-035670 | A | 2/2013 | |
| KR | 20140003704 | A | 1/2014 | |

* cited by examiner

TRANSPORT CART SYSTEM

BACKGROUND OF THE INVENTION

1. Field of the Invention

An aspect of the present invention relates to a transport vehicle system.

2. Description of the Related Art

As a transport vehicle system, a system including a transport vehicle configured to travel along a track and a control device configured to control the transport vehicle is known (refer to, for example, Japanese Unexamined Patent Publication No. 2013-35670).

SUMMARY OF THE INVENTION

With the technology described above, for example, if a failure occurs in a power supply device in a system, system failure may be caused in which the entire system goes down (becomes not in normal operating condition).

Preferred embodiments of the present invention provide transport vehicle systems each capable of preventing system failure.

A transport vehicle system according to an aspect of a preferred embodiment of the present invention includes a transport vehicle to travel along a track, a controller configured or programmed to control the transport vehicle, and a power supply provided at each of a plurality of sections of the track, in which each of the power supplies includes a sensor to monitor a state of the power supply and a communicator to transmit a monitoring result by the sensor to the controller, and the controller is configured or programmed to control the transport vehicle in accordance with the monitoring result.

In this transport vehicle system, the power supplies are provided in the respective sections, the state of each power supply is monitored by the sensor in the power supply, and the transport vehicle is controlled by the controller accordance with the monitoring result. As a result, if a failure occurs in the power supply, the controller can perform a process by which the system goes only partially down, but the entire system does not go down. Thus, it is possible to prevent the system failure of the transport vehicle system.

In a transport vehicle system according to an aspect of a preferred embodiment of the present invention, the controller may determine, based on the monitoring results, whether the respective states of the power supplies are in an abnormal state, and the controller may prohibit entry of the transport vehicle into the section corresponding to the power supply determined to be in the abnormal state, and cause the transport vehicle present in the section to be evacuated from the section. As a result, it is possible to efficiently reduce or prevent the propagation of influence due to the failure of the power supply over the entire system.

In a transport vehicle system according to an aspect of a preferred embodiment of the present invention, the controller may further control the power supplies, and may stop the power supply determined to be in the abnormal state. As a result, it is possible to efficiently reduce or prevent the propagation of influence due to the failure of the power supply over the entire system.

In a transport vehicle system according to an aspect of a preferred embodiment of the present invention, the controller may determine, based on the monitoring results, whether the respective states of the power supplies are in a warning state, a degree of abnormality of which is lower than that of the abnormal state, and may limit acceleration of the transport vehicle present in the section corresponding to the power supply determined to be in the warning state. As a result, it is possible to efficiently reduce or prevent the propagation of influence due to the failure of the power supply over the entire system.

In a transport vehicle system according to an aspect of a preferred embodiment of the present invention, when the power supply is determined to be in the abnormal state by the controller and the abnormal state is of a temperature anomaly, information on temperature distribution in the power supply determined to be in the abnormal state may be transmitted from the communicator to the controller. As a result, a user can easily determine at the controller a temperature distribution that results in a temperature anomaly in the power supply.

In a transport vehicle system according to an aspect of a preferred embodiment of the present invention, the monitoring result may include first information including at least one of temperature data and power data of the power supply and second information regarding whether the power supply is in the abnormal state, the first information may be transmitted from the communicator to the controller in a first cycle, and the second information may be transmitted from the communicator to the controller in a second cycle shorter than the first cycle, when the power supply is normal. As a result, when the first information and the second information are periodically transmitted from the power supply to the controller, a communication cycle of the first information the data volume of which is larger than that of the second information is longer than a communication cycle of the second information. Thus, communication traffic volume of the communicator can be reduced.

According to preferred embodiments of the present invention, it is possible to provide transport vehicle systems capable of preventing system failure.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will now be described in detail with reference to the drawings. In the description of the drawings, identical or equivalent elements are marked with the same symbol, and redundant explanations are omitted. The words "up" and "down" correspond to a vertical direction, the words "front" and "rear" correspond to an advancing direction of a traveling vehicle, and the words "left" and "right" correspond to a direction orthogonal to an up-down direction and a front-back direction.

Figure 1:
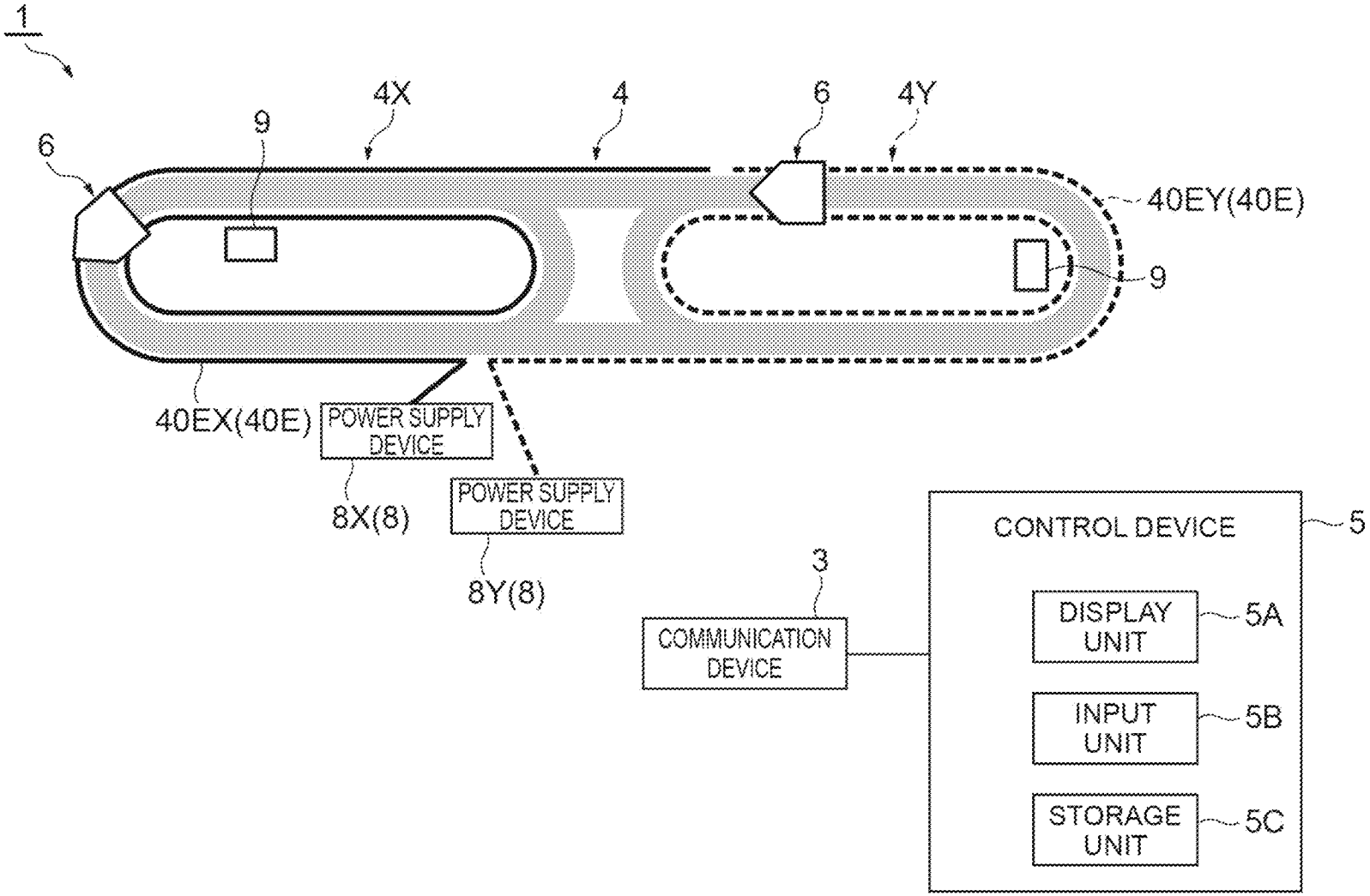
FIG. 1 is a schematic view illustrating an example of a transport vehicle system according to a preferred embodiment of the present invention.
Figure 2:
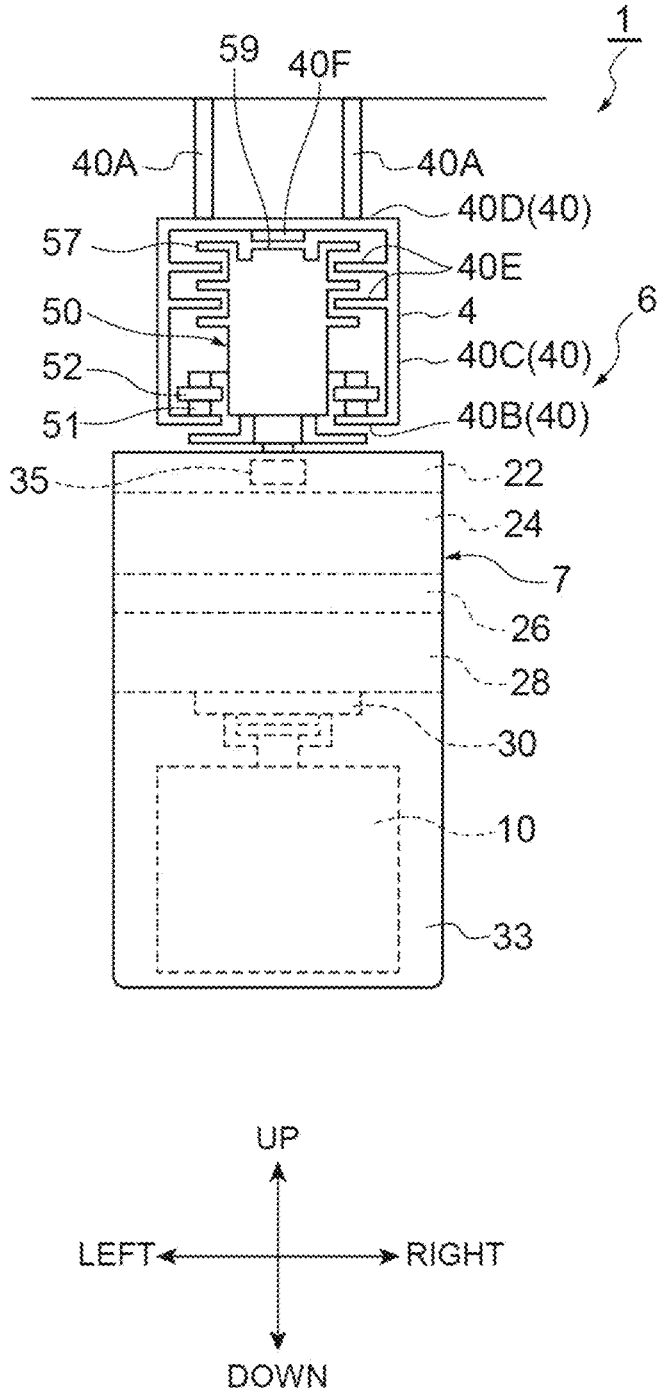
FIG. 2 is a front schematic diagram illustrating the transport vehicle in FIG. 1 when viewed from a traveling direction.

As illustrated in FIG. 1 and FIG. 2, the transport vehicle system 1 is a system configured to transport an article 10 between a plurality of loading portions 9 using a transport vehicle 6 in, for example, a factory or the like. The transport vehicle system 1 includes the transport vehicle 6 configured to travel along a track 4, the plurality of loading portions 9 each on which the article 10 is placed, a control device 5 configured to control the transport vehicle 6, and a power supply device 8 configured to supply power to the transport vehicle 6. Examples of the article 10 include containers such as a front opening unified pod (FOUP) storing a plurality of semiconductor wafers, a reticle pod storing a glass substrate, general components, and the like.

The track 4 is, for example, a track laid near a ceiling, which is an overhead space of a worker. The track 4 is suspended from the ceiling. The track 4 is a predetermined traveling path on which the transport vehicle 6 travels. The track 4 is divided into a plurality of sections. In an example illustrated in the drawing, the track 4 is divided into a first section 4X and a second section 4Y.

The track 4 is supported by posts 40A. The track 4 includes a rail body 40 having a C shape including a pair of lower surfaces 40B, a pair of side surfaces 40C, and a ceiling surface 40D, power supply units 40E, and a magnetic plate 40F. The lower surfaces 40B each extend in the traveling direction of the transport vehicle 6 and define a lower surface of the rail body 40. The lower surfaces 40B each are a plate-shaped member on which a traveling roller 51 of the transport vehicle 6 rolls to travel. The side surfaces 40C each extend in the traveling direction of the transport vehicle 6 and define side surfaces of the rail body 40. The ceiling surface 40D extends in the traveling direction of the transport vehicle 6 and defines a top surface of the rail body 40.

The power supply unit 40E supplies power to a power receiving core 57 of the transport vehicle 6 and transmits and receives signals to and from the transport vehicle 6. The power supply unit 40E is a feeder line fixed to each of the pair of side surfaces 40C and extending along an extending direction of the track 4. The power supply unit 40E provides power to the power receiving core 57 in a non-contact state. The power supply unit 40E is provided for each of the sections of the track 4. The power supply unit 40E includes a first power supply unit 40EX extending along the track 4 in the first section 4X and a second power supply unit 40EY extending along the track 4 in the second section 4Y.

The magnetic plate 40F generates a magnetic force for a linear DC motor (LDM) 59 of the transport vehicle 6 to travel or stop. The magnetic plate 40F is fixed to the ceiling surface 40D and extends along the traveling direction. The length, the shape, and the layout of the track 4 are not limited to the example illustrated in the drawings, but may be of various lengths, shapes, and layouts.

The transport vehicle 6 travels along the track 4 and transports the article 10. The transport vehicle 6 is configured to be able to transfer the article 10. The transport vehicle 6 is an overhead traveling unmanned vehicle. The number of transport vehicles 6 provided by the transport vehicle system 1 is not limited, and is one or more. The transport vehicle 6 is also referred to as, for example, a transport vehicle, overhead traveling vehicle, overhead transport vehicle, or a traveling cart. The transport vehicle 6 includes a main unit 7, a traveling unit 50, and a traveling vehicle controller 35. The main unit 7 includes a main frame 22, a lateral feed unit 24, a θ drive 26, a lifting drive unit 28, a lifting platform 30, and a front-rear frame 33.

The lateral feed unit 24 collectively feeds the 0 drive 26, the lifting drive unit 28, and the lifting platform 30 horizontally in a direction perpendicular to the traveling direction on the track 4. The θ drive 26 rotates at least one of the lifting drive unit 28 and the lifting platform 30 within a predetermined angular range in a horizontal plane. The lifting drive unit 28 raises and lowers the lifting platform 30 by winding and unwinding lifting materials such as a belt, a wire, and a rope. The lifting platform 30 is provided with a chuck, thereby allowing the article 10 to be grasped or released. A pair of the front-rear frames 33 are provided at, for example, the front and the rear of the transport vehicle 6 in the traveling direction of the transport vehicle 6. The front-rear frames 33 each allow claws and other parts, which are not illustrated, to advance or retreat, thereby preventing the article 10 from falling during transport.

The traveling unit 50 causes the transport vehicle 6 to travel along the track 4. The traveling unit 50 includes traveling rollers 51, side rollers 52, a power receiving core 57, and the LDM 59. The traveling rollers 51 are disposed at both of the right and the left ends on the front and the rear of the traveling unit 50. The traveling rollers 51 roll over the pair of lower surfaces 40B of the track 4. The side rollers 52 are disposed so as to sandwich the traveling rollers 51 in the front-back direction. The side rollers 52 are provided in a manner of being capable of contacting the side surfaces 40C of the track 4. The power receiving cores 57 are disposed on the front and the rear of the traveling unit 50 so as to sandwich the LDM 59 in the right-left direction. The power receiving core 57 receives power from the power supply unit 40E disposed in the track 4 in a non-contact manner and performs transmission and reception of various signals between the power supply unit 40E and the traveling vehicle controller 35 in a non-contact manner. The LDMs 59 are provided at the front and the rear of the traveling unit 50. The LDM 59 generates a magnetic force for traveling or stopping.

The traveling vehicle controller 35 is an electronic control unit including a central processing unit (CPU), a read only memory (ROM), a random access memory (RAM), and the like. The traveling vehicle controller 35 controls various types of operations of the transport vehicle 6. Specifically, the traveling vehicle controller 35 controls the traveling unit 50, the lateral feed unit 24, the θ drive 26, the lifting drive unit 28, and the lifting platform 30. The traveling vehicle controller 35 can be configured, for example, as software such that a program stored in the ROM is loaded into the RAM to be executed by the CPU. The traveling vehicle controller 35 may be configured as hardware including an electronic circuit or the like. The traveling vehicle controller 35 communicates with the control device 5 using the power supply unit 40E and the like.

The loading portion 9 is disposed along the track 4. The loading portion 9 is provided at a position where the article 10 can be passed by the transport vehicle 6. The loading portion 9 includes a buffer on which the article 10 is temporarily placed, and a load port to pass the article 10 with respect to a processing apparatus (not illustrated).

The control device 5 is an electronic control unit including a CPU, a ROM, a RAM, and the like. The control device 5 can be configured, for example, as software such that a program stored in the ROM is loaded into the RAM to be executed by the CPU. The control device 5 may be configured as hardware including an electronic circuit or the like. The control device 5 controls various operations in the transport vehicle system 1. The control device 5 controls the transport vehicle 6 and the power supply device 8. The control device 5 includes a display unit 5A such as a monitor configured to display various types of information, an input unit 5B such as a keyboard and a mouse receiving various types of operational input from the user, and a storage unit 5C configured to store various types of information.

The control device 5 is connected to a communication device 3. The communication device 3 is a device configured to communicate with the power supply device 8. The communication device 3 outputs various types of information received from the power supply device 8 to the control device 5. The communication device 3 transmits various types of information input from the control device 5 to the power supply device 8. The communication device 3 is not limited and can be, for example, a publicly known communication converter.

The control device 5 requests a plurality of the power supply devices 8 to transmit temperature-power information (first information) regarding the temperature data and the power data of the power supply devices 8, via the communication device 3. The control device 5 acquires the temperature-power information transmitted from the power supply device 8 in response to the request via the communication device 3. The control device 5 requests the power supply devices 8 via the communication device 3 to transmit device state information (second information) regarding whether the power supply device 8 is in the abnormal state, the warning state, or a normal state. The control device 5 acquires the device state information transmitted from the power supply device 8 in response to the request via the communication device 3. The control device 5 stores the acquired temperature-power information and the device state information in the storage unit 5C.

The power supply device 8 is provided at each of the sections of the track 4. Here, the power supply device 8 includes a power supply device 8X installed corresponding to the first section 4X of the track 4 and a power supply device 8Y installed corresponding to the second section 4Y of the track 4. The power supply device 8X is connected to the first power supply unit 40EX in the first section 4X. The power supply device 8Y is connected to a second power supply unit 49EY in the second section 4Y.

Figure 3:
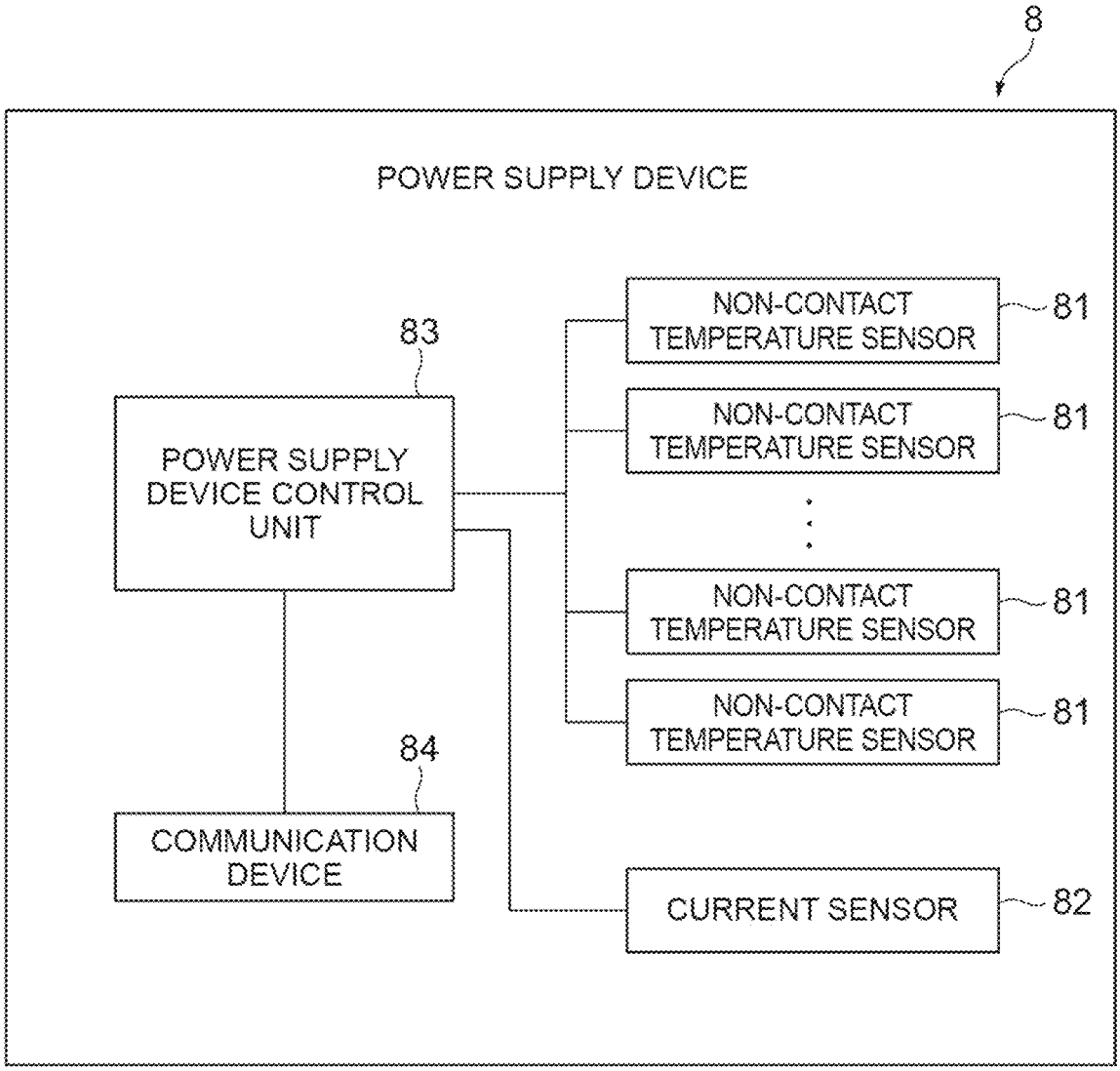
FIG. 3 is a block diagram illustrating a configuration of a power supply device in FIG. 1.

As illustrated in FIG. 3, the power supply device 8 includes a plurality of non-contact temperature sensors 81, a current sensor 82, a power supply device control unit 83, and a communication device 84. The non-contact temperature sensor 81 is a sensor configured to monitor the temperature of the power supply device 8. A thermopile array sensor, for example, is used as the non-contact temperature sensor 81. Each of the non-contact temperature sensors 81 measures, in a non-contact manner, the temperature of each of a plurality of areas different from each other in the power supply device 8. Each of the non-contact temperature sensors 81 detects the temperature distribution in the corresponding area and outputs information on the temperature distribution as temperature data to the power supply device control unit 83. For example, in temperature data, the temperature distribution is associated with the identification number of each non-contact temperature sensor 81. The current sensor 82 is a sensor configured to monitor the current at a predetermined measurement point in the power supply device 8. The current sensor 82 detects the current at the predetermined measurement point and outputs information on the current as current data to the power supply device control unit 83.

The power supply device control unit 83 is an electronic control unit including a CPU, a ROM, and a RAM. The power supply device control unit 83 controls various operations in the power supply device 8. The power supply device control unit 83 can be configured, for example, as software such that a program stored in the ROM is loaded into the RAM to be executed by the CPU. The power supply device control unit 83 may be configured as hardware such as an electronic circuit or the like.

The power supply device control unit 83 determines which state, out of the abnormal state, the warning state, and the normal state, the power supply device 8 is in, based on the temperature data and the power data. The warning state is a state in which the degree of abnormality is lower than that of the abnormal state. For example, the power supply device control unit 83 determines that the power supply device 8 is in the warning state when the power data is equal to or more than a first power threshold. For example, the power supply device control unit 83 determines that the power supply device 8 is in the abnormal state when the power data is equal to or more than the second power threshold value greater than the first power threshold value. For example, the power supply device control unit 83 determines that the power supply device 8 is in the warning state when any of the highest temperatures in the respective temperature distributions in the temperature data is equal to or more than the first temperature threshold. For example, in the power supply device control unit 83, the power supply device 8 is in the abnormal state (temperature anomaly) when any of the highest temperatures in the respective temperature distributions in the temperature data is equal to or more than the second temperature threshold value greater than the first temperature threshold. In other cases than the above, the power supply device control unit 83 determines that the power supply device 8 is in the normal state.

The power supply device control unit 83 outputs the result of determining which state, out of the abnormal state, the warning state, and the normal state, the power supply device 8 is in to the communication device 84, in response to the request from the control device 5, as device state information. The data size of the device state information is, for example, about 20 bytes to about 80 bytes. The device state information may include an error log. The power supply device control unit 83 outputs the temperature data and the power data to the communication device 84 as the temperature-power information in response to the request from the control device 5. The data size of the temperature-power information is, for example, about 80 bytes to about 204 bytes.

The non-contact temperature sensor 81 and the current sensor 82 define a monitor device configured to monitor the state of the power supply device 8. The temperature-power information and the device state information define the monitoring result of the state of the power supply device 8 monitored by the monitor device (hereinafter referred to simply as "monitoring result of the power supply device 8").

The communication device 84 is a device configured to communicate with the control device 5 via the communication device 3. The communication device 84 outputs the various types of information received to the power supply device control unit 83. The communication device 84 transmits various types of information input from the power supply device control unit 83 to the control device 5. The communication device 84 transmits the monitoring result of the power supply device 8 to the control device 5 (details will be described later). The communication device 84 is not limited and can be, for example, a publicly known communication converter.

In the present preferred embodiment, the control device 5 controls the transport vehicle 6 in accordance with the monitoring results of the power supply devices 8. Based on the monitoring results of the power supply devices 8, the control device 5 determines whether the power supply devices 8 are in the abnormal state. The control device 5, when determining that at least one of the power supply devices 8 is in the abnormal state, prohibits the transport vehicle 6 from entering a section corresponding to the power supply device 8 determined to be in the abnormal state on the track 4, and causes the transport vehicle 6 present in the section to be evacuated from the section. The control device 5 stops the power supply device 8 determined to be in the abnormal state. The stopping the power supply device 8 includes at least stopping power supply to the power supply unit 40E connected to the power supply device 8.

Based on the monitoring results of the power supply devices 8, the control device 5 determines whether the power supply devices 8 are in the warning state. The control device 5, when determining that at least one of the power supply devices 8 is in the warning state, limits the acceleration of the transport vehicle 6 present in a section corresponding to the power supply device 8 determined to be in the warning state on the track 4.

The control device 5, when determining that at least one of the power supply devices 8 is in the abnormal state, further determines whether the abnormal state is of the temperature anomaly. The control device 5, when determining that the abnormal state is of the temperature anomaly, causes the temperature data of the power supply device 8 determined to be in the abnormal state to be transmitted from the communication device 84 of the power supply device 8 to the control device 5. As a result, the control device 5 generates an image of the temperature distribution that results in the temperature anomaly based on the transmitted temperature data, and displays the temperature distribution image on the display unit 5A. Details of the various processes involving the processing of the control device 5 will be described later.

Figure 4:
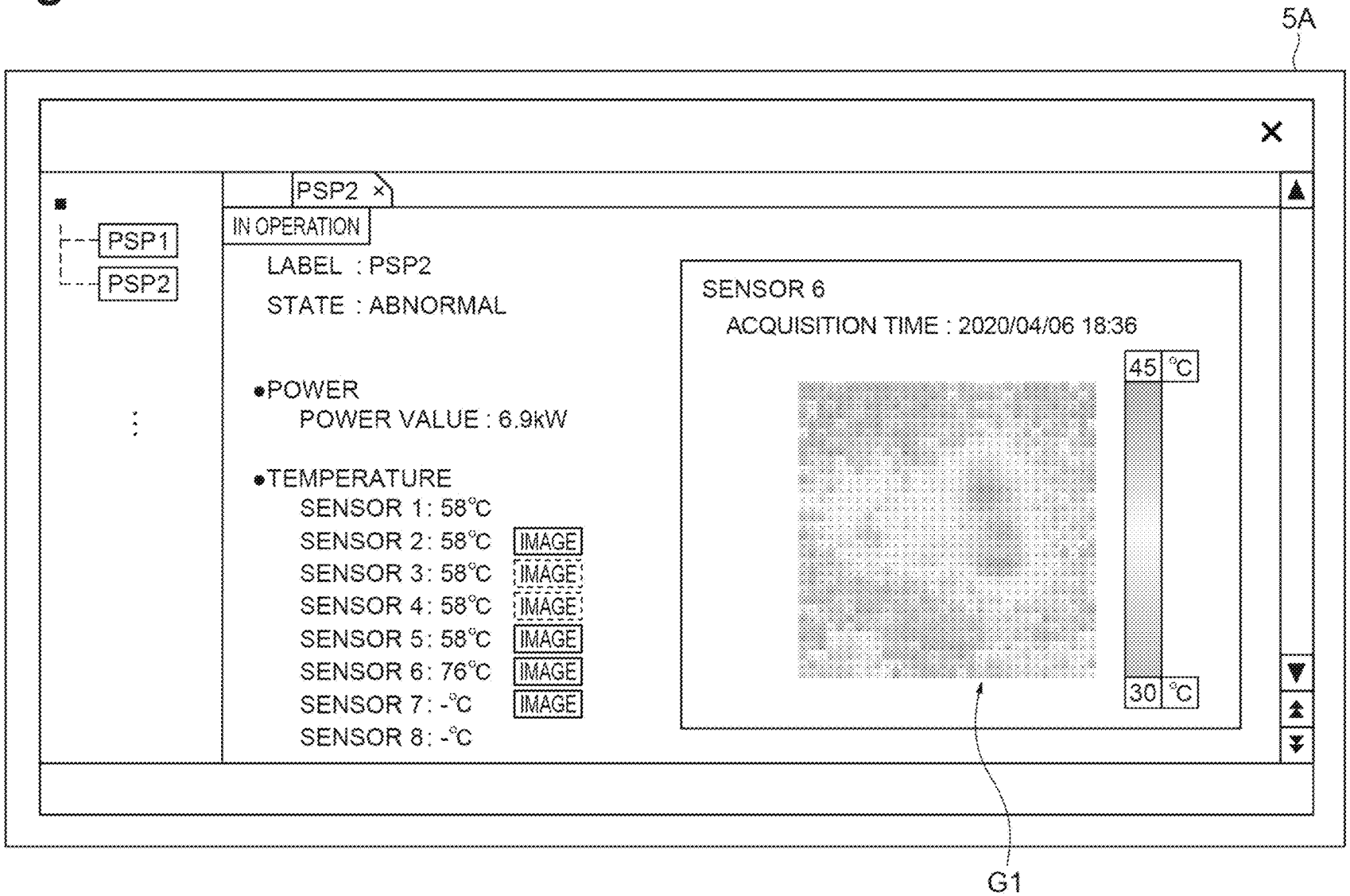
FIG. 4 is a diagram illustrating a display example displayed on a display unit of the control device in FIG. 1.

FIG. 4 is a diagram illustrating a display example to be displayed on the display unit 5A of the control device 5. The display example illustrated in FIG. 4 is an example where a temperature anomaly occurs in the power supply device 8 labeled with PSP2, among the power supply device 8 labeled with PSP1 and the power supply device 8 labeled with PSP2. The display unit 5A displays a temperature distribution image G1 according to the temperature distribution of the temperature anomaly in the power supply device 8 labeled with PSP2 and an acquisition time of the temperature distribution image G1. Besides, the display unit 5A displays various types of information on the power supply device 8 labeled with PSP2 in which the temperature anomaly has occurred. Examples of the various types of information displayed on the display unit 5A include, for example, a label of the power supply device 8, a state of the power supply device 8, whether the power supply device 8 is in operation, power data of the power supply device 8, and the highest temperatures in the respective temperature distributions detected by the corresponding non-contact temperature sensors 81.

In such a display of the display unit 5A, for example, when the user clicks the "PSP1" button by operating the input unit 5B, the display can be switched to various types of information on the power supply device 8 labeled with PSP1. In addition, in such a display of the display unit 5A, for example, when the user clicks the "Image" button by operating the input unit 5B, the display can be switched to the image data of the temperature distribution of the corresponding non-contact temperature sensor 81. Moreover, in such a display of the display unit 5A, for example, the user can set the "temperature bar" of the temperature distribution image G1 by operating the input unit 5B.

Next, various processes executed by the transport vehicle system 1 in the present preferred embodiment will be described.

Figure 5B:
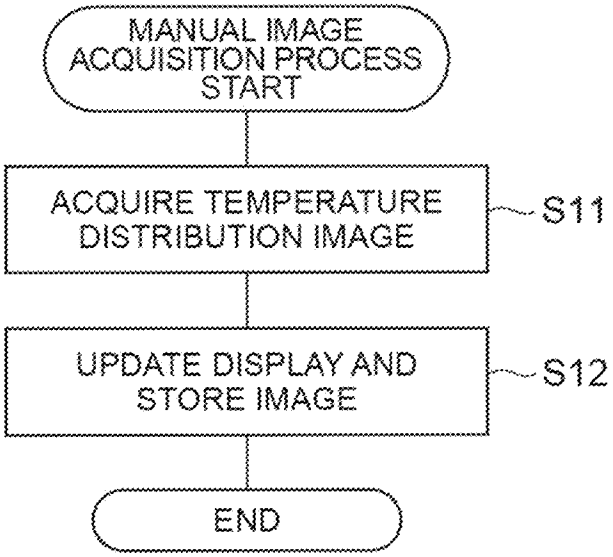
FIG. 5B is a flowchart illustrating a manual image acquisition process of the transport vehicle system in FIG. 1.
Figure 5A:
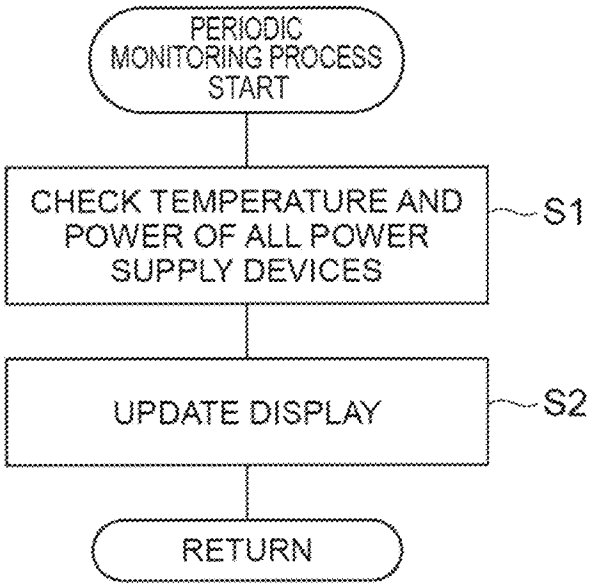
FIG. 5A is a flowchart illustrating a periodic monitoring process of the transport vehicle system in FIG. 1.

The transport vehicle system 1 periodically repeats the following periodic monitoring process in a first cycle (about 10 seconds, for example). In the periodic monitoring process, as illustrated in FIG. 5A, the temperature and the power of all the power supply devices 8 are first checked by the control device 5 (step S1). In step S1, specifically, a request for the temperature-power information is made from the control device 5 to all the power supply devices 8 via the communication device 3. Each of the power supply devices 8 receives the request via the communication device 84 and transmits the temperature-power information to the communication device 3 in response to the request. The control device 5 acquires the temperature-power information via the communication device 3 and stores the acquired temperature-power information in the storage unit 5C.

Then, the display of the display unit 5A is updated by the control device 5 so that the acquired temperature-power information is displayed (step S2). The display aspect and display format of the display unit 5A are not particularly limited and may be in various types of aspects and formats (the same applies hereinafter). The step then advances to the processing in above-described step S1 in the next cycle to check the temperature and the power of all the power supply devices 8 again. In other words, the temperature-power information is transmitted from the communication device 84 to the control device 5 in the first cycle.

In the transport vehicle system 1, the following manual image acquisition process is executed when the user operates the input unit 5B to display on the display unit 5A a temperature distribution image of the temperature distribution detected by the non-contact temperature sensor 81 of a certain power supply device 8. In the manual image acquisition process, as illustrated in FIG. 5B, a temperature distribution image of a target to be displayed is first acquired by the control device 5 (step S11).

In step S11, specifically, a request for the temperature-power information is made from the control device 5 to the power supply device 8 as the target via the communication device 3 in response to the operation received at the input unit 5B. The power supply device 8 as the target receives the request via the communication device 84 and transmits the temperature-power information to the communication device 3 in response to the request. The control device 5 acquires the temperature-power information via the communication device 3, acquires the temperature distribution of the target from the temperature data in the temperature-power information, and generates a temperature distribution image based on the acquired temperature distribution using, for example, a publicly known method.

The display of the display unit 5A is then updated by the control device 5 so that the acquired temperature distribution image is displayed. Along with this, the acquired temperature distribution image is stored in the storage unit 5C (step S12). As in the foregoing, the manual image acquisition process ends. Priority of the manual image acquisition process is set lower than that of the above-described periodic monitoring process. Therefore, when each piece of processing of the periodic monitoring process is being executed, each piece of processing of the manual image acquisition process is not executed.

Figure 6:
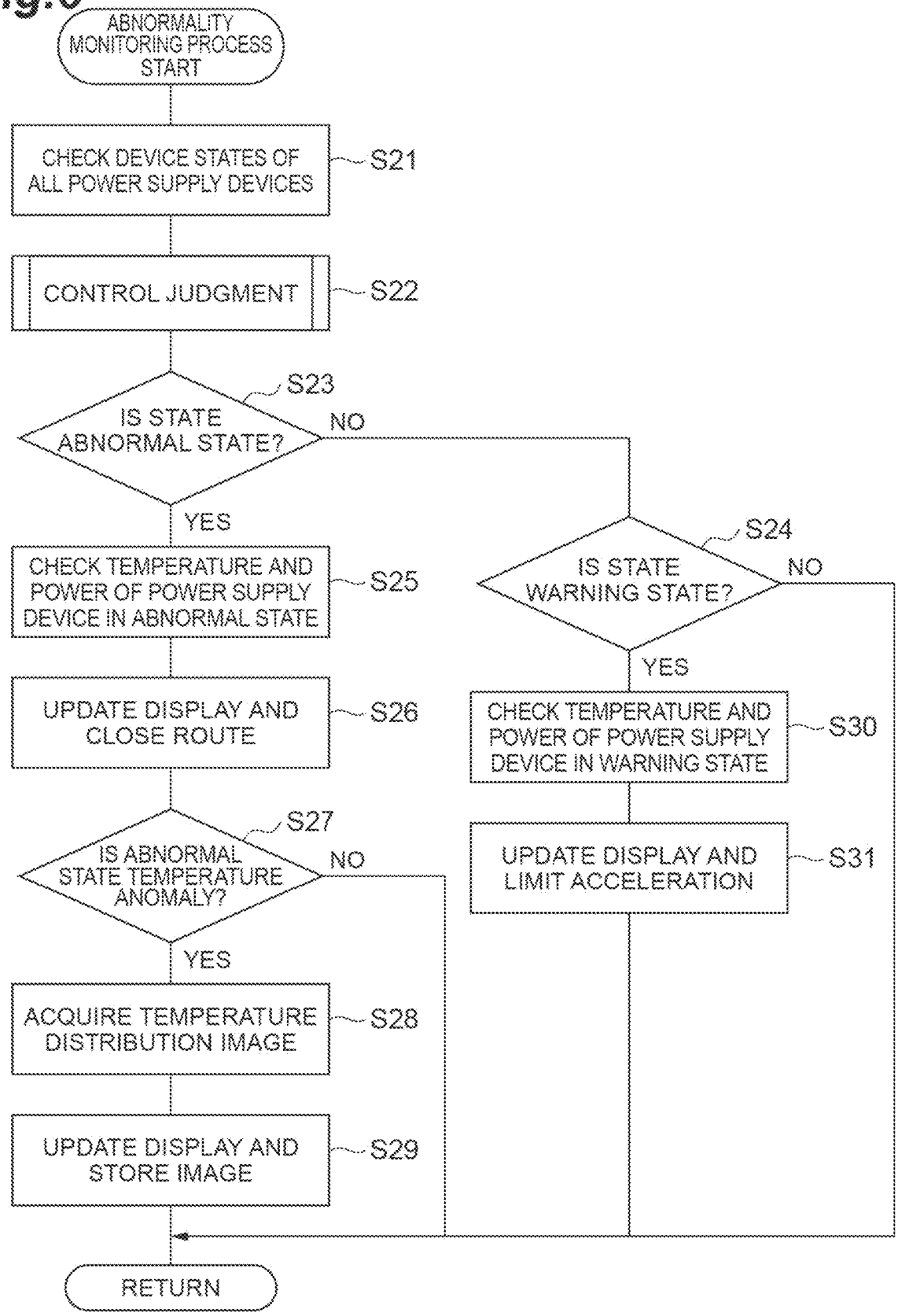
FIG. 6 is a flowchart illustrating an abnormality monitoring process of the transport vehicle system in FIG. 1.

In the transport vehicle system 1, the abnormality monitoring process described below is periodically executed. In the abnormality monitoring process, as illustrated in FIG. 6, first the device states of all the power supply devices 8 are checked by the control device 5 (step S21). In step S21, specifically, a request for the device state information is made from the control device 5 to all the power supply devices 8 via the communication device 3. Each of the power supply devices 8 receives the request via the communication device 84 and transmits the device state information to the communication device 3 in response to the request. The control device 5 acquires the device state information via the communication device 3 and stores the acquired device state information in the storage unit 5C.

Control judgment is then performed by the control device 5 to determine the device state of each of the power supply devices 8 based on the acquired device state information (step S22). In step S22, the control device 5 refers to the device state information to determine which state, out of the abnormal state, the warning state, and the normal state, each of the power supply devices 8 is in.

If none of the power supply devices 8 are in the abnormal state or in the warning state (NO in step S23 and NO in step S24), a series of processing in the current cycle is terminated, and the step advances to the processing in above-described step S21 in the second cycle (1 second, for example) shorter than the first cycle. In other words, the device state information is transmitted from the communication device 84 to the control device 5 in the second cycle shorter than the first cycle, when the power supply device 8 is normal.

On the other hand, if at least one of the power supply devices 8 is in the abnormal state (YES in step S23), the temperature and the power of the power supply device 8 in that abnormal state are checked (step S25). In step S25, specifically, a request for temperature-power information is made from the control device 5 to the power supply device 8 in the abnormal state via the communication device 3. The power supply device 8 in the abnormal state receives the request via the communication device 84 and transmits the temperature-power information to the communication device 3 in response to the request. The control device 5 acquires the temperature-power information via the communication device 3 and stores the acquired temperature-power information in the storage unit 5C.

Then, by the control device 5, the display of the display unit 5A is updated so that the acquired temperature-power information is displayed, and the abnormal section, which is a section corresponding to the power supply device 8 determined to be in the abnormal state in the track 4, is closed by route closure (step S26). In the route closure in step S26, the entry of the transport vehicle 6 into the abnormal section of the track 4 is prohibited, and the transport vehicle 6 present in the abnormal section is evacuated from that abnormal section. For example, in the route closure in step S26, when some command (a travel command or a transport command, for example) is allocated to the transport vehicle 6, a command to evade the abnormal section is allocated. For example, in the route closure in step S26, a command to cause the transport vehicle 6 present in the abnormal section to travel outside the abnormal section is allocated. In step S26, the control device 5 stops the power supply device 8 determined to be in the abnormal state.

Then, based on the device state information of the power supply device 8 in the abnormal state, whether the abnormal state of the power supply device 8 is of the temperature anomaly is determined by the control device 5 (step S27). If the abnormal state of the power supply device 8 is of the temperature anomaly (YES in step S27), a temperature distribution image according to the temperature distribution that results in the temperature anomaly is acquired by the control device 5 (step S28).

In step S28, specifically, a request for the temperature-power information is made from the control device 5 to the power supply device 8 in the abnormal state via the communication device 3. The power supply device 8 in the abnormal state receives the request via the communication device 84 and transmits the temperature-power information to the communication device 3 in response to the request. The control device 5 acquires the temperature-power information via the communication device 3 and acquires the temperature distribution that results in the temperature anomaly from the temperature data in the temperature-power information. Based on the acquired temperature distribution, the control device 5 generates a temperature distribution image using, for example, a publicly known method. In other words, in step S28, when the power supply device 8 is determined to be in the abnormal state by the control device 5 and the abnormal state is of the temperature anomaly, information on the temperature distribution in the power supply device 8 determined to be in the abnormal state (the temperature-power information) is transmitted from the communication device 84. Then, by the control device 5, the display of the display unit 5A is updated and the acquired temperature distribution image is stored in the storage unit 5C so that the acquired temperature distribution image is displayed (step S29).

On the other hand, if none of the power supply devices 8 are in the abnormal state and at least one of the power supply devices 8 is in the warning state (NO in step S23 and YES in step S24), the temperature and the power of that power supply device 8 in the warning state is checked (step S30). In step S30, specifically, a request for the temperature-power information is made from the control device 5 to the power supply device 8 in the warning state via the communication device 3. The power supply device 8 in the warning state receives the request via the communication device 84 and transmits the temperature-power information to the communication device 3 in response to the request. The control device 5 acquires the temperature-power information via the communication device 3 and stores the acquired temperature-power information in the storage unit 5C.

Then, by the control device 5, the display of the display unit 5A is updated so that the acquired temperature-power information is displayed, and the acceleration of the transport vehicle 6 in a warning section, which is a section corresponding to the power supply device 8 determined to be in the warning state in the track 4, is limited (step S31). As an example, in the limiting of the acceleration in step S31, the maximum acceleration specified by a command to be allocated to the transport vehicle 6 present in the warning section is set to a value equal to or less than the preset acceleration.

If NO in step S27, after step S29, or after step S31, a series of processing in the current cycle is terminated, and the step advances to the processing in the above-described step S21 in the next cycle. Priority of the abnormality monitoring process is set lower than that of the above-described periodic monitoring process and manual image acquisition process. Therefore, when any of the periodic monitoring process or the manual image acquisition process is being executed, each piece of processing of the abnormality monitoring process is not executed.

As in the foregoing, in the transport vehicle system 1, the power supply device 8 is provided in each of the sections made by dividing the track 4, the state of each of the power supply devices 8 is monitored by the non-contact temperature sensors 81 and the current sensor 82, and in accordance with the monitoring results of the power supply devices 8, the transport vehicle 6 is controlled by the control device 5. As a result, if a failure occurs in the power supply device 8, the control device 5 can perform a process by which the system goes only partially down, but the entire system does not go down. Thus, it is possible to prevent the system failure of the transport vehicle system 1.

In the transport vehicle system 1, the control device 5 determines whether the power supply devices 8 are in the abnormal state based on the monitoring results of the power supply devices 8. The control device 5 prohibits the entry of the transport vehicle 6 into the abnormal section corresponding to the power supply device 8 determined to be in the abnormal state, and causes the transport vehicle 6 present in the abnormal section to be evacuated from that abnormal section. As a result, it is possible to efficiently reduce or prevent the propagation of influence due to the failure of the power supply device 8 over the entire system. The transport vehicle system 1 can continue to operate with reduced transport capacity.

In the transport vehicle system 1, the control device 5 stops the power supply device 8 determined to be in the abnormal state. As a result, it is possible to efficiently reduce or prevent the propagation of influence due to the failure of the power supply device 8 over the entire system. It is possible to prevent the failure of the power supply device 8 from developing. Early recovery of the power supply device 8 from the failure is made easier.

In the transport vehicle system 1, the control device 5 determines, based on the monitoring results of the power supply devices 8, whether the power supply devices 8 are in the warning state, and limits the acceleration of the transport vehicle 6 present in the warning section corresponding to the power supply device 8 that is determined to be in the warning state. As a result, it is possible to efficiently reduce or prevent the propagation of influence due to the failure of the power supply device 8 over the entire system. The transport vehicle system 1 can continue to operate with reduced transport capacity.

In the transport vehicle system 1, when the control device 5 determines that the power supply device 8 is in the abnormal state and the abnormal state is of the temperature anomaly, the temperature-power information on the temperature distribution in the power supply device 8 determined to be in the abnormal state is transmitted from the communication device 84 to the control device 5. As a result, in the control device 5, the temperature distribution that results in the temperature anomaly in the power supply device 8 can be displayed as a temperature distribution image on the display unit 5A. The user can easily grasp at the control device 5 the temperature distribution that results in the temperature anomaly in the power supply device 8.

In the transport vehicle system 1, the temperature-power information is transmitted from the communication device 84 to the control device 5 in the first cycle. The device state information is transmitted from the communication device 84 to the control device 5 in the second cycle shorter than the first cycle, when the power supply device 8 is normal. As a result, when the temperature-power information and the device state information are periodically transmitted from the power supply device 8 to the control device 5, the communication cycle of temperature-power information the data volume of which is larger than that of the device state information is longer than the communication cycle of device state information. Thus, the communication traffic volume of the communication device 84 can be reduced. In addition, the communication load can be reduced.

In the transport vehicle system 1, desired temperature-power information and device state information can be displayed in a simplified manner by the display unit 5A. In addition, the display of the display unit 5A can be easily set and operated. Moreover, it is possible to display the temperature distribution image of the temperature distribution according to the temperature anomaly, on the display unit 5A when the user operates or when the power supply device 8 is in the abnormal state.

Although the preferred embodiments have been described above, an aspect of the present invention is not limited to the above-described preferred embodiments, and various modifications may be made within the scope not departing from the gist of the present invention.

In the above-described preferred embodiments, the monitor device is not limited to the non-contact temperature sensor 81 and the current sensor 82, but may be any other sensor or the like capable of monitoring the state of the power supply device 8. In the above-described preferred embodiments, the power supply device 8 may exclusively include only the non-contact temperature sensors 81 or the current sensor 82. In the above-described preferred embodiments, an area in which each non-contact temperature sensor 81 measures temperature in the power supply device 8 is not limited and may be various areas. In the above-described preferred embodiments, a measurement point at which the current sensor 82 measures the current in the power supply device 8 is not limited and may be various measurement points.

In the above-described preferred embodiments, the first cycle when the communication device 84 transmits the temperature-power information and the second cycle when the communication device 84 transmits the device state information are not particularly limited, and it is sufficient that the second cycle is shorter than the first cycle. The first cycle and the second cycle may be fixed values, or may be variable values that vary according to the situation. In the above-described preferred embodiments, the control device 5, when determining that the power supply device 8 is in the abnormal state or the warning state, may make some notification (a caution on the display unit 5A, for example) to alert the user to the power supply device 8 in problem.

In the above-described preferred embodiments, an example with the two power supply devices 8 is illustrated and explained, but the number of the power supply devices 8 is not limited and it is sufficient that the number is more than one. The above-described preferred embodiments may include a plurality of units, each including the plurality of power supply devices 8 and the control device 5. In this case, a higher-level control device configured to control the control devices 5 may be included. The above-described preferred embodiments may include a data server configured to manage data for the entire system. The above-described preferred embodiments may include an overall control device configured to control the entire system. In the above-described preferred embodiments, wireless communication or wired communication may be used for part or all of the communication. In the above-described preferred embodiments, a LAN connection of a facility in which the transport vehicle system 1 is installed, for example, may be used for part or all of the communication.

In the above-described preferred embodiments, stopping the power supply device 8 in the abnormal state, prohibiting the entry of the transport vehicle 6 into an abnormal section, evacuating the transport vehicle 6 present in the abnormal section from that abnormal section, and limiting the acceleration of the transport vehicle 6 present in a warning section are executed, but it is sufficient at least one of these steps is executed.

The materials and shapes of the respective configurations in the preferred embodiments and the modifications above are not limited to those described above, and various materials and shapes can be used. Each configuration in the preferred embodiments or the modifications above may be optionally applied to each configuration in other preferred embodiments or modifications. Some of the respective configurations in the preferred embodiments or the modifications above may be omitted as appropriate within the scope not departing from the gist of an aspect of the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A transport vehicle system comprising:

a transport vehicle to travel along a track;

a controller configured or programmed to control at least one operation of the transport vehicle; and a power supply provided at each of a plurality of sections of the track; wherein each of the power supplies includes a sensor to monitor a state of the power supply and a communicator to transmit a monitoring result by the sensor to the controller;

the sensor includes a plurality of temperature sensors to measure temperature data of the power supply;

the monitoring result transmitted from the communicator to the controller includes first information including at least one of the temperature data and power data of the power supply, and second information regarding whether the power supply is in an abnormal state;

the second information regarding whether the power supply is in the abnormal state is based on the temperature data and the power data of the power supply;

the controller is configured or programmed to request the first information from the power supply based on the second information;

the communicator outputs the first information to the controller when the controller requests the first information from the power supply; and the controller is configured or programmed to control the at least one operation of the transport vehicle in accordance with the monitoring result.

2. The transport vehicle system according to claim 1, wherein the controller is configured or programmed to:

determine, based on the monitoring result, whether the respective states of the power supplies are in the abnormal state; and prohibit entry of the transport vehicle into the section corresponding to the power supply determined to be in the abnormal state, or cause the transport vehicle present in the section to be evacuated from the section.

3. The transport vehicle system according to claim 2, wherein the controller is configured or programmed to further control the power supplies and stops the power supply determined to be in the abnormal state.

4. The transport vehicle system according to claim 2, wherein the controller is configured or programmed to:

determine, based on the monitoring result, whether the respective states of the power supplies are in a warning state corresponding to a degree of abnormality of which is lower than that of the abnormal state.

5. The transport vehicle system according to claim 2, wherein when the power supply is determined to be in the abnormal state by the controller and the abnormal state is of a temperature anomaly, information on a temperature distribution in the power supply determined to be in the abnormal state is transmitted from the communicator to the controller.

6. The transport vehicle system according to claim 1, wherein the first information is transmitted from the communicator to the controller in a first cycle; and the second information is transmitted from the communicator to the controller in a second cycle shorter than the first cycle, when the power supply is in a normal state.

7. The transport vehicle system according to claim 1, wherein the plurality of sections of the track include a first section of track and a second section of track;

the first section of track includes a first power supply line to provide power to the transport vehicle on the first section of track;

the second section of track includes a second power supply line to provide power to the transport vehicle on the second section of track;

the power supplies include a first power supply and a second power supply;

the first power supply supplies power to the first power supply line; and the second power supply supplies power to the second power supply line.

* * * * *